United States Patent [19]

Kobayashi

[11] Patent Number: 4,652,347

[45] Date of Patent: Mar. 24, 1987

[54] PROCESS FOR ELECTROPLATING AMORPHOUS ALLOYS

[76] Inventor: Masami Kobayashi, 31-5-201, Seijyo 2-chome, Setagaya-ku, Tokyo, Japan

[21] Appl. No.: 816,534

[22] Filed: Jan. 6, 1986

[30] Foreign Application Priority Data

Jan. 7, 1985 [JP] Japan ..... 60-000122

[51] Int. Cl.[4] ..... C25D 5/34

[52] U.S. Cl. ..... 204/34; 204/32.1

[58] Field of Search ..... 204/32.1, 34

[56] References Cited

U.S. PATENT DOCUMENTS 3,726,773 4/1973 Lamb et al. ..... 204/129.35

4,422,906 12/1983 Kobayashi ..... 204/34

OTHER PUBLICATIONS

F. A. Lowenheim, *Electroplating*, McGraw-Hill Book Co., New York, 1978, pp. 1–4.

*Primary Examiner*—John F. Niebling

*Assistant Examiner*—William T. Leader

*Attorney, Agent, or Firm*—Armstrong, Nikaido, Marmelstein & Kubovcik

[57] ABSTRACT

An amorphous alloy article having solderability is obtained by subjecting an amorphous alloy article to an immersion treatment with an acidic activating bath comprising hydrochloric acid, citric acid, nitric acid, a nonionic or amphoteric surface active agent; electroactivating the amorphous alloy with a cathode-electrolytic bath comprising phosphoric acid, sulfuric acid, citric acid and a nonionic or amphoteric surface active agent; and immediately thereafter electroplating the electroactivated amorphous alloy with a metal selected from copper, nickel, tin, zinc and alloys thereof.

5 Claims, No Drawings

PROCESS FOR ELECTROPLATING AMORPHOUS ALLOYS

BACKGROUND OF THE INVENTION (1) Field of the Invention

This invention relates to a process for electroplating an amorphous alloy with a metal selected from copper, nickel, tin, zinc and alloys thereof.

(2) Description of the Related Art

An amorphous alloy is utilized as an electronic part or the like because of its excellent magnetic characteristics, but this amorphous alloy has a problem in that its solderability is poor. This poor solderability is due to a strong passive film formed on the surface of the amorphous alloy, and the solder-ability is inhibited by the amorphousness of the inherent alloy structure. Thus, when the amorphous alloy is used as an electronic material, the end portion must be made solderable for connection thereof.

The compression method may be adopted for connection to the amorphous alloy, but the connecting effect is low and unstable, and even if strong compression is possible, the conduction of electricity is inhibited by the passive film present on the surface.

Furthermore, since the amorphous alloy is brittle, bending processing is difficult, and connection by bending or torsion is not applicable because the amorphous alloy will break.

A welding method such as spot welding may be considered. However, in the welding method, since the temperature of the welded portion is elevated, the composition of the amorphous alloy is changed and the metal characteristics of the amorphous alloy are lost. Accordingly, welding cannot be applied.

Accordingly, various investigations have been made into making the soldering of amorphous alloys possible, but none have been successful.

This is because the removal of a passive film inherent to an amorphous alloy and the disposal of silicon and boron contained in the amorphous alloy are difficult, and since the history of amorphous alloys is short, research has not been widely carried out.

SUMMARY OF THE INVENTION

In view of the foregoing, it is a primary object of the present invention to provide a process for electroplating an amorphous alloy wherein the passive film is substantially completely removed from the amorphous alloy without corrosion of the substrate of the alloy and thus a metal plating having an excellent adhesion property is obtained.

In accordance with the present invention, there is provided a process for electroplating amorphous alloys, which comprises the steps of:

subjecting an amorphous alloy to an immersion treatment with an acidic activating bath comprising, based on the weight of the acidic activating bath:

(i) 3 to 20% by weight of hydrochloric acid,
(ii) 2 to 30% by weight of sulfuric acid,
(iii) 2 to 15% by weight of citric acid,
(iv) 0 to 3% by weight of acetic acid,
(v) 2 to 10% by weight of nitric acid,
(vi) 0.1 to 0.3% by weight of a nonionic or amphoteric surface active agent,
(vii) 0 to 0.15% by weight of an amine corrosion inhibitor, (viii) 0 to 20% by weight of 2-pyrrolidone or its N-alkyl derivative, and
(ix) 0 to 10% by weight of an acetylenic glycol;

electroactivating the thus-treated amorphous alloy with a cathode-electrolytic bath comprising, based on the weight of the cathode-electrolytic bath:

(i) 2 to 20% by weight of phosphoric acid,
(ii) 2 to 30% by weight of sulfuric acid,
(iii) 2 to 15% by weight of citric acid,
(iv) 0 to 5% by weight of acetic acid,
(v) 0.1 to 0.3% by weight of a nonionic or amphoteric surface active agent,
(vi) 0 to 0.15% by weight of an amine corrosion inhibitor, and
(vii) 0 to 20% by weight of 2-pyrrolidone or its N-alkyl derivative; and immediately thereafter electroplating the thus-electroactivated amorphous alloy with at least one metal selected from the group consisting of copper, nickel, tin, zinc and alloys thereof.

DESCRIPTION OF THE PREFERRED EMBODIMENTS

The amorphous alloy used in the present invention may be conventional and usually comprises, based on the weight of the amorphous alloy, 10 to 95% by weight of at least one metal selected from iron, cobalt and nickel, 5 to 70% by weight of at least one element selected from silicon, boron, carbon, phosphorus and aluminum, and 0 to 30% by weight of at least one metal selected from titanium, chromium, molybdenum, manganese, zirconium, neodymium, hafnium, tungsten and niobium.

In the present invention, it is preferable that, prior to the treatment of an amorphous alloy with the acidic activating bath, the amorphous alloy is treated with an organic solvent such as trichlene and/or an aqueous alkali solution whereby grease and other foreign matter are removed from the amorphous alloy.

The alkali treatment may be carried out according to the conventional method using a commercially available alkali solution. According to one preferred embodiment, the amorphous iron alloy is dipped in a dilute aqueous alkali solution at an elevated temperature and electrolytic degreasing is then carried out in a dilute aqueous alkali solution.

After the alkali treatment, the amorphous alloy is subjected to an activating treatment in two stages. Namely, the activating treatment comprises the first step of dipping in an acidic activating solution (this step is called as "chemical polishing") and the subsequent step of cathodic electrolysis in a cathodic electrolytic solution. This activating treatment will now be described.

The activating solution used in the first activating treatment is comprised of, based on the weight of the solution:

(i) 3 to 20% by weight of hydrochloric acid,
(ii) 2 to 30% by weight of sulfuric acid,
(iii) 2 to 15% by weight of citric acid,
(iv) 0 to 3% by weight of acetic acid,
(v) 2 to 10% by weight of nitric acid,
(vi) 0.1 to 0.3% by weight of a nonionic or amphoteric surface active agent,
(vii) 0 to 0.15% by weight of an amine corrosion inhibitor,
(viii) 0 to 20% by weight of 2-pyrrolidone or its N-alkyl derivative, and
(ix) 0 to 10% by weight of an acetylenic glycol.

If the amount of hydrochloric acid, nitric acid and sulfuric acid are too small, no substantial activating effect can be obtained, and if the amount of these acids are too large, over-pickling and hydrogen brittlement tend to occur. Citric acid and acetic acid enhance the activating effect.

If the amount of the nonionic or amphoteric surface active agent is smaller than 0.1% by weight, it is impossible to reduce the surface tension of the activating solution to the desired value, i.e., 30 dyne/cm or lower, and this surfactant need not be incorporated in an amount exceeding 5% by weight. The nonionic surface active agent used includes, for example, polyethylene glycol alkyl ethers and polyethylene glycol fatty acid esters. The amphoteric surface active agent includes, for example, polyacrylamide and various amino acids.

The acetylenic glycol exerts a function of preventing surface clouding, i.e., preventing the formation of a new passive film after the removal of the original passive film. As the acetylenic glycol, 2-pentyne-1,4-diol and 2-butyne-1,4-diol are preferably used.

It is considered that 2-pyrrolidone or its N-alkyl derivative exerts a function of assuredly removing the passive film and surface oxide dissolved in the mixed acid by virtue of excellent dissolving and washing powers thereof. If also exerts a function of assisting the acetylenic glycol's effect of preventing surface clouding. As the N-alkyl derivative of 2-pyrrolidone, those which have an alkyl group of 1 to 5 carbon atoms, are used. Preferable N-alkyl derivatives are N-ethyl2-pyrrolidone and N-methyl-2-pyrrolidone.

The first activation treatment may be carried out by dipping the amorphous alloy in the acidic activating solution at room temperature for 30 seconds to 7 minutes.

The activated amorphous alloys are then subjected to cathode electrolytic activation. The cathode electrolytic activation solution used in this step is an aqueous solution comprising, (i) 2 to 20% by weight of phosphoric acid,
(ii) 2 to 30% by weight of sulfuric acid,
(iii) 2 to 15% by weight of citric acid,
(iv) 0 to 5% by weight of acetic acid,
(v) 0.1 to 0.3% by weight of a nonionic or amphoteric surface active agent,
(vi) 0 to 0.15% by weight of an amine corrosion inhibitor, and
(vii) 0 to 20% by weight of 2-pyrrolidone or its N-alkyl derivative.

If the amount of phosphoric acid is smaller than 2% by weight, no substantial cathode electrolytic activating effect can be attained, and if the amount of phosphoric acid exceeds 20% by weight, no substantial increase of the effect can be obtained.

The functions of sulfuric acid, citric acid, acetic acid, a nonionic or amphoteric surface active agent, and 2-pyrrolidone or its alkyl derivative are the same as those which are described above with regard to the acidic activating solution.

At the cathode electrolytic activation step, electrolysis may be carried out at room temperature at a cathode current density of 1 to 7 A/dm$^2$ for 30 seconds to 5 minutes by using a platinum-plated titanium anode and the amorphous alloy as the cathode.

The amorphous alloy which has been subjected to the activating treatment is then subjected to electrolytic plating with at least one metal selected from copper, nickel, tin, zinc and alloys thereof. This electro-plating should be carried out immediately after the activating treatment for preventing the formation of a passive film on the surface. The plating is performed according to the conventional electrolytic method using an electrolytic solution containing salts of the respective metals, wherein the amorphous alloy is the cathode and the respective metals are the anode.

The electroplating may be carried out either in a single step or two or more steps. When the electroplating is carried out in a single step, the following conditions are employed. Temperature: room temperature to 60° C., cathode current density: 3 to 20 A/dm$^2$, time: 20 sec to 10 min. When the electroplating is carried out in two steps, the following conditions are employed.

| | First step | Second step |
|---|---|---|
| Temperature: | Room temperature to 60° C. | Room temperature to 60° C. |
| Cathode current density: | 3–20 A/dm$^2$ | 3–20 A/dm$^2$ |
| Time: | 5 sec. to 1 min. | 20 sec. to 10 min. |

Examples of the electrolyte solutions used in the electroplating are as follows.

| | | |
|---|---|---|
| Cu plating | | |
| First step | Copper sulfate | 10–50 g/l |
| | Citric acid | 50–150 g/l |
| | Sodium citrate | 50–150 g/l |
| Second step | Copper sulfate | 50–200 g/l |
| | Sulfuric acid | 20–60 g/l |
| Ni plating | Nickel sulfate or sulfamate | 50–700 g/l |
| | Nickel chloride | 20–70 g/l |
| | Boric acid | 20–60 g/l |
| Zn plating | Zinc sulfate | 50–400 g/l |
| | Ammonium chloride | 5–30 g/l |
| | Aluminum sulfate | 10–60 g/l |
| Sn plating | Stannous sulfate | 20–80 g/l |
| | Sulfuric acid | 30–100 g/l |
| | Gelatin | 0.5–4 g/l |

The composition of the activating baths used in the present invention was found as the result of trial and error based on various experiments. The intended effect can be attained by the synergistic actions of the respective components. Accordingly, the foregoing conditions are indispensible in the present invention, and if the above requirements of the ingredients to be used in combination and the amounts thereof are not satisfied, it is difficult to obtain a metal plating having an excellent adhesion property by completely removing the passive film without corrosion of the substrate in the surface portion of an amorphous alloy.

The present invention will now be described in detail with reference to the following examples that by no means limit the scope of the invention.

EXAMPLE 1

An amorphous alloy hoop having an alloy composition comprising 44.3% by weight of Fe, 44.2% by weight of Ni, 7.9% by weight of Mo, and 3.6% by weight of B, and having a thickness of 27μm, a width of 25 mm, and a length of 1,800 m, was plated with copper through the following steps.

Step (1): Ordinary degreasing and washing with trichlene.

Step (2): Ordinary alkali degreasing.

Step (3): Chemical polishing.

Subsequent to step (2), the amorphous alloy hoop was passed through a bath formed by adding 0.2% by weight of a non-ionic surface active agent (polyethylene glycol alkyl ether) 5% by weight of N-metyl-2-pyrrolidone, 1% by weight of 2-butyne-1,4-diol and 0.1% by weight of an amine corrosion inhibitor to a mixed acid comprising 20% by volume of hydrochloric acid (35% solution), 10% by volume of sulfuric acid (85% solution), 10% by weight of citric acid (powder), 1% by volume of acetic acid (90% solution), and 5% by volume of nitric acid (68% solution), to remove oxides and impurities from the surface of the amorphous alloy hoop.

Step (4): Electrolytic activating.

A bath formed by adding 0.2% by weight of a nonionic surface active agent (the same as mentioned above), 5% by weight of N-methyl-2-pyrrolidone and 0.1% by weight of an amine corrosion inhibitor to a mixed acid comprising 10% by volume of phosphoric acid (85% solution), 10% by volume of sulfuric acid (85% solution), 5% by weight of citric acid (powder), and 1% by volume of acetic acid (90% solution) was heated at 65° C., and a negative current was applied to the amorphous alloy hoop and a positive current was applied to a platinum-deposited titanium plate to produce a voltage of 4 volts. In this state, the amorphous alloy hoop was passed through the bath to activate the surface of the amorphous alloy hoop.

Step (5): Strike-plating with copper.

The plating operation was carried out at a current density of 6 A/dm$^2$ for 10 seconds in a plating bath comprising 20 g/l of copper sulfate, 90 g/l of citric acid, and 90 g/l of sodium citrate to obtain a copper plating having a thickness of 0.02 to 0.03$\mu$m.

Step (6): Copper plating.

The plating operation was carried out at a current density of 2 A/dm$^2$ for 2 minutes in a plating bath comprising 180 g/l of copper sulfate and 45 g/l of sulfuric acid to obtain a copper plating having a thickness of about 2$\mu$m.

EXAMPLE 2

A bobbin-wound wire having a diameter of 0.15 mm and a length of 5,000 mm, which was composed of an amorphous alloy having a composition comprising 86% by weight of Co, 6% by weight of Fe, 5% by weight of Si, and 3% by weight of B, was plated with tin through the following steps.

For steps (1) through (4), the treatments were carried out in the same manner as described in Example 1, and the amorphous alloy wire was surface-activated.

Step (5): Tin plating.

The tin plating operation was carried out at a current density of 1.5 A/dm$^2$ for 3 minutes in a bath comprising 40 g/l of stannous sulfate, 60 g/l of sulfuric acid, and 2 g/l of gelatin to form a tin plating having a thickness of 1.5$\mu$m on the surface of the amorphous alloy wire.

EXAMPLE 3

An amorphous alloy hoop having an alloy composition comprising 92% of Fe, 5.0% of Si, and 3% of B, and having a thickness of 27$\mu$m, a width of 50 mm, and a length of 700 mm, was nickel-plated through the following steps.

For steps (1) through (4), the treatments were carried out in the same manner as described in Example 1 to activate the surface of the amorphous alloy hoop.

Step (5): Strike plating with nickel.

The plating operation was carried out at a current density of 6 A/dm$^2$ for 10 seconds in a plating bath comprising 50 g/l of nickel sulfamate, 50 g/l of nickel sulfate, 40 g/l of boric acid, and 45 g/l of citric acid to obtain a nickel plating having a thickness of about 0.03$\mu$m.

Step (6): Nickel plating.

The plating operation was carried out at a current density of 10 A/dm$^2$ for 3 minutes by setting a nickel plate as the anode in a plating bath comprising 600 g/l of nickel sulfamate, 5 g/l of nickel chloride, and 40 g/l of boric acid.

A nickel plating having an excellent adhesion and a thickness of about 2$\mu$m was formed on the surface of the amorphous alloy hoop.

EXAMPLE 4

An amorphous alloy hoop as described in Example 3 was plated with zinc.

The treatments of steps (1) through (4) were carried out in the same manner as described in Example 1 to activate the surface of the amorphous alloy hoop.

Step (5): Zinc plating.

The plating operation was carried out at a current density of 2 A/dm$^2$ for 5 minutes in a bath comprising 240 g/l of zinc sulfate, 15 g/l of ammonium chloride, and 30 g/l of aluminum sulfate to form a zinc plating having a thickness of about 4$\mu$m on the surface of the amorphous alloy hoop.

The results of the plating adhesion and solderability tests of the plated amorphous alloys obtained in Examples 1 through 4 were as described below, and it was confirmed that the amorphous alloys had excellent plating characteristics.

(1) Peeling Resistance

At any of (1) the 180° bending test, (2) the adhesive tape peel test, and (3) the quenching test after heating at 400° C. for 10 minutes, peeling of the plating layer from the amorphous alloy was not observed.

(2) Solderability

From the results of the test using a soldering test machine, it was found that the solder wettability was very good and substantial rising by the surface tension of the solder at the initial stage of soldering was not observed.

When the plated amorphous alloy hoops and wires obtained in the four examples were immersed in a solder tank filled with a melt of a solder composed of 60% by weight of tin and 40% by weight of lead, all had a solder wettability higher than 95%.

Since plating and soldering of an amorphous alloy are difficult, the use of the amorphous alloy has been limited mainly to a magnetic core where magnetic characteristics are utilized. However, according to the present invention, as is apparent from the foregoing description, the electroplating of an amorphous alloy with various metals such as copper, nickel, tin, and zinc becomes possible, and solderability is imparted to the amorphous alloy. Accordingly, a novel composite material comprising an amorphous alloy having excellent magnetic characteristics and a plated surface layer of a metal having a high electroconductivity can be provided and connected by soldering, although connection of an amorphous alloy by soldering is impossible by the conventional technique. Moreover, fabrication of a woven texture of an amorphous alloy wire becomes possible. Thus, characteristics of amorphous alloys other than the magnetic characteristics can be effectively utilized in various fields.

I claim:

1. A process for electroplating amorphous alloys, which comprises the steps of:

subjecting an amorphous alloy to an immersion treatment with an acidic activating bath comprising, based on the weight of the acidic activating bath:

(i) 3 to 20% by weight of hydrochloric acid,
(ii) 2 to 30% by weight of sulfuric acid,
(iii) 2 to 15% by weight of citric acid,
(iv) 0 to 3% by weight of acetic acid,
(v) 2 to 10% by weight of nitric acid,
(vi) 0.1 to 0.3% by weight of a nonionic or amphoteric surface active agent,
(vii) 0 to 0.15% by weight of an amine corrosion inhibitor,
(viii) 0 to 20% by weight of 2-pyrrolidone or its N-alkyl derivative, and
(ix) 0 to 10% by weight of an acetylenic glycol;

cathodically activating the thus-treated amorphous alloy with an electrolytic bath consisting essentially of based on the weight of the electrolytic bath:

(i) 2 to 20% by weight of phosphoric acid,
(ii) 2 to 30% by weight of sulfuric acid,
(iii) 2 to 15% by weight of citric acid,
(iv) 0 to 5% by weight of acetic acid,
(v) 0.1 to 0.3% by weight of a nonionic or amphoteric surface active agent,
(vi) 0 to 0.15% by weight of an amine corrosion inhibitor, and
(vii) 0 to 20% by weight of 2-pyrrolidone or its N-alkyl derivative; and immediately thereafter electroplating the thus-electroactivated amorphous alloy with at least one metal selected from the group consisting of copper, nickel, tin, zinc and alloys thereof.

2. A process according to claim 1, wherein the amorphous alloy is composed of, based on the weight of the amorphous alloy, 10 to 95% by weight of at least one metal selected from iron, cobalt and nickel, 5 to 70% by weight of at least one element selected from silicon, boron, carbon, phosphorus and aluminum, and 0 to 30% by weight of at least one metal selected from titanium, chromium, molybdenum, manganese, zirconium, neodymium, hafnium, tungsten and niobium.

3. A process according to claim 1, wherein the immersion treatment of the amorphous alloy in the acidic activating bath is carried out for 30 seconds to 7 minutes.

4. A process according to claim 1, wherein the electroactivation is carried out at a cathode current density of 1 to 7 $A/dm^2$ for 30 seconds to 5 minutes.

5. A process according to claim 1, wherein the electroplating of the electroactivated amorphous alloy is carried out at a temperature of room temperature to 60° C. at a cathode current density of 3 to 20 $A/dm^2$.

* * * * *